US005896161A

United States Patent [19]

Kobayashi

[11] Patent Number: 5,896,161

[45] Date of Patent: Apr. 20, 1999

[54] METHOD OF PRINTING A HIGH-QUALITY IMAGE, USING A THERMAL TRANSFER PRINTER

[75] Inventor: Hiroshi Kobayashi, Iwate-ken, Japan

[73] Assignee: Alps Electric Co., Ltd., Tokyo, Japan

[21] Appl. No.: 09/014,900

[22] Filed: Jan. 29, 1998

[30] Foreign Application Priority Data

Jan. 20, 1997 [JP] Japan ..... 9-036199
Jan. 29, 1997 [JP] Japan ..... 9-015088

[51] Int. Cl.[6] ..... B41J 2/325
[52] U.S. Cl. ..... 347/212
[58] Field of Search ..... 347/212; 400/120.18

[56] References Cited

U.S. PATENT DOCUMENTS 4,666,320 5/1987 Kobayashi et al. ..... 347/212
4,716,145 12/1987 Vanier et al. ..... 347/212
5,538,351 7/1996 Miyano ..... 347/172
5,631,688 5/1997 Hibino et al. ..... 347/171

FOREIGN PATENT DOCUMENTS 58-148779 9/1983 Japan ..... 347/212
61-173956 8/1986 Japan .
62-132680 6/1987 Japan ..... 347/212

*Primary Examiner*—Huan Tran
*Attorney, Agent, or Firm*—Brinks Hofer Gilson & Lione

[57] ABSTRACT

A thermal transfer printer capable of providing an image with high recording quality without dullness even in the event of recording on paper using an ink ribon of heat-melt ink or heat-sublimation ink comprises a platen 2, a carriage 4, and a thermal head 7. The thermal transfer printer records a desired image on paper by transferring the heat-melt ink or heat-sublimation ink on an ink ribbon 17 onto the paper, and subsequently smoothes the image recorded on the paper by pressing the thermal head 7 against the surface of the recorded image with the heat-resistant film 27 introduced between the surface of the thermal head 7 and the recorded image.

1 Claim, 3 Drawing Sheets

METHOD OF PRINTING A HIGH-QUALITY IMAGE, USING A THERMAL TRANSFER PRINTER

BACKGROUND OF THE INVENTION

1. Field of the Invention

The present invention relates to a thermal transfer printer, and particularly to a thermal transfer printer which obtains a high-quality printed image that is not dull, by means of smoothing the surface of the image following printing.

2. Description of the Prior Art

Thermal transfer printers which are a type of recording apparatus are generally and widely used a output devices for computers, word processors, and the like, due to characteristics thereof such as high recording quality, low noise, low cost, and ease of maintenance.

Such known thermal transfer printers are constructed such that a carriage is enabled to reciprocally move along a platen, a thermal head formed of an array of a plurality of heat-emitting devices is provided to this carriage, and a ribbon cassette storing an ink ribbon of a desired color is detachably mounted thereto.

The ink ribbon fed from the aforementioned ribbon cassette and the printing paper are held between the aforementioned platen and thermal head, the thermal head is caused to move reciprocally with the carriage along the platen, and by means of selectively causing electroconducting of the heat-emitting devices of the aforementioned thermal head based on recording information while spooling the aforementioned ink ribbon, the ink of the ink ribbon is partially transferred into the paper, thereby recording the desired characters or images thereon.

Also, in the case of performing full-color printing on the paper, three ribbon cassettes storing ink ribbons formed of ink of at least the three colors of yellow, magenta, and cyan, are provided. Each of the ribbon cassettes are automatically exchanged between the carriage for recording.

Regarding such known thermal transfer printers, a widely known method is to record on recording paper using an ink ribbon comprised of a resin film of a material such as PET (polyethylene-terepthalate) coated with heat-melt ink, but in recent years, a method has come to be known in which an ink ribbon coated with heat-sublimation ink is used for recording on paper.

Of these, in the event that the method of recording on paper using the ink ribbon comprising heat-melt ink is employed, the user can record of a wide variety of mediums, such as plain paper, cardboard, postcards, etc. In this way, this method exhibits excellent useability.

On the other hand, in the event that the ink ribbon comprising heat-sublimation ink is used, or in more specific terms, in the event that recording on paper is performed using an ink ribbon formed by coating a base of material formed from a resin film such as PET or the like with heat-sublimation ink, the amount of sublimation of the heat-sublimation ink can be adjusted by means of controlling the energy applied to the thermal head, thus allowing adjustment of the concentration of the image recorded on the paper. Hence, a full-color image rivaling the image quality of silver-salt photography can be obtained by using a special paper of which surface has been treated. Thus, thermal transfer printers using ink ribbons comprised of heat-sublimation ink have come to be widely used as high-quality video printers.

However, regarding thermal transfer printers which use ink ribbons comprised of the aforementioned heat-melt ink, and particularly regarding thermal transfer printers which use ink ribbons comprised of heat-melt ink wherein resin has been used as a coloring agent and also a binder, the surface of the ink transferred onto the paper may be uneven due to peeling of the ink ribbon at the time of transferring/recording, the edge portion of the transferred dots may be peeled back, and further in the event that recording of full-color images using ink of the three colors, yellow, magenta, and cyan is performed, a great deal of unevenness has been generated on the surface of the image recorded on the paper, owing to up to three ink colors being overlaid.

Accordingly, unevenness on the surface of the image causes irregular reflection of white light at this portion, deterioration of saturation creates the problem of dullness, and this has been an obstruction in obtaining a recorded image of higher quality.

Also, regarding thermal transfer printers which use ink ribbons comprised of the aforementioned heat-sublimation ink, in the event that heat-sublimation ink is transferred onto the paper to record the desired image on the paper, the amount of energy supplied to the thermal head for heat-sublimation of the heat-sublimation ink on the ink ribbon is small at portions where the color of the recorded image is light and the concentration is low, and as a result, the heat-sublimation ink transferred onto the paper is smooth and the obtained image is glossy and vivid. On the other hand, the amount of energy supplied to the thermal head for heat-sublimation of the heat-sublimation ink on the ink ribbon is great at portions where the recorded image is black and the concentration is high, and as a result, so-called matting wherein the image transferred to the paper becomes dull due to thermal warping of the surface of the paper, and consequently, glossy portions and dull portions exist in the recorded image in a mixed manner, and this has been an obstruction in obtaining a recorded image of higher quality.

Also, there has been the problem that this matting is exhibited even more markedly in the event that recording of full-color images using heat-sublimation ink of the three colors, yellow, magenta, and cyan is performed.

SUMMARY OF THE INVENTION

Accordingly, it is an object of the present invention to provide a thermal transfer printer capable of obtaining an image with high recording quality without dullness called matting, even in the event of recording on paper using heat-melt ink or heat-sublimation ink.

It is another object of the present invention to provide a thermal transfer printer wherein, following the desired recording onto the recording paper, the aforementioned thermal head is subjected to electroconducting while the thermal head is pressed against the surface of the aforementioned recorded image with a heat-resistant film inserted between the recorded image and the thermal head so as to smooth the surface of the recorded image, thereby not only obtaining an image with high recording quality without dullness called matting, but also preventing ink from the recorded image adhering to and soiling the thermal head or dust or the like adhering to and damaging the surface of the thermal head, by means of pressing the thermal head against the surface of the recorded image while sliding over the surface of the image, with a heat-resistant film inserted between.

It is a further object of the invention to provide a thermal transfer printer wherein the electroconducting of the aforementioned thermal head at the time of smoothing the surface of the aforementioned recorded image is conducted with energy lower than that of the maximum electroconducting energy of the thermal head during recording by transferring the ink of the ink ribbon onto the paper, thereby obtaining an image with high recording quality without dullness called matting, and also, preventing blotching of ink transferred into the paper and assisting in dispersion and coloring of the ink, thus obtaining a color recorded image of even higher quality.

DETAILED DESCRIPTION OF THE PREFERRED EMBODIMENT

The an embodiment of the present embodiment will now be described with reference to the drawings.

Figure 1:
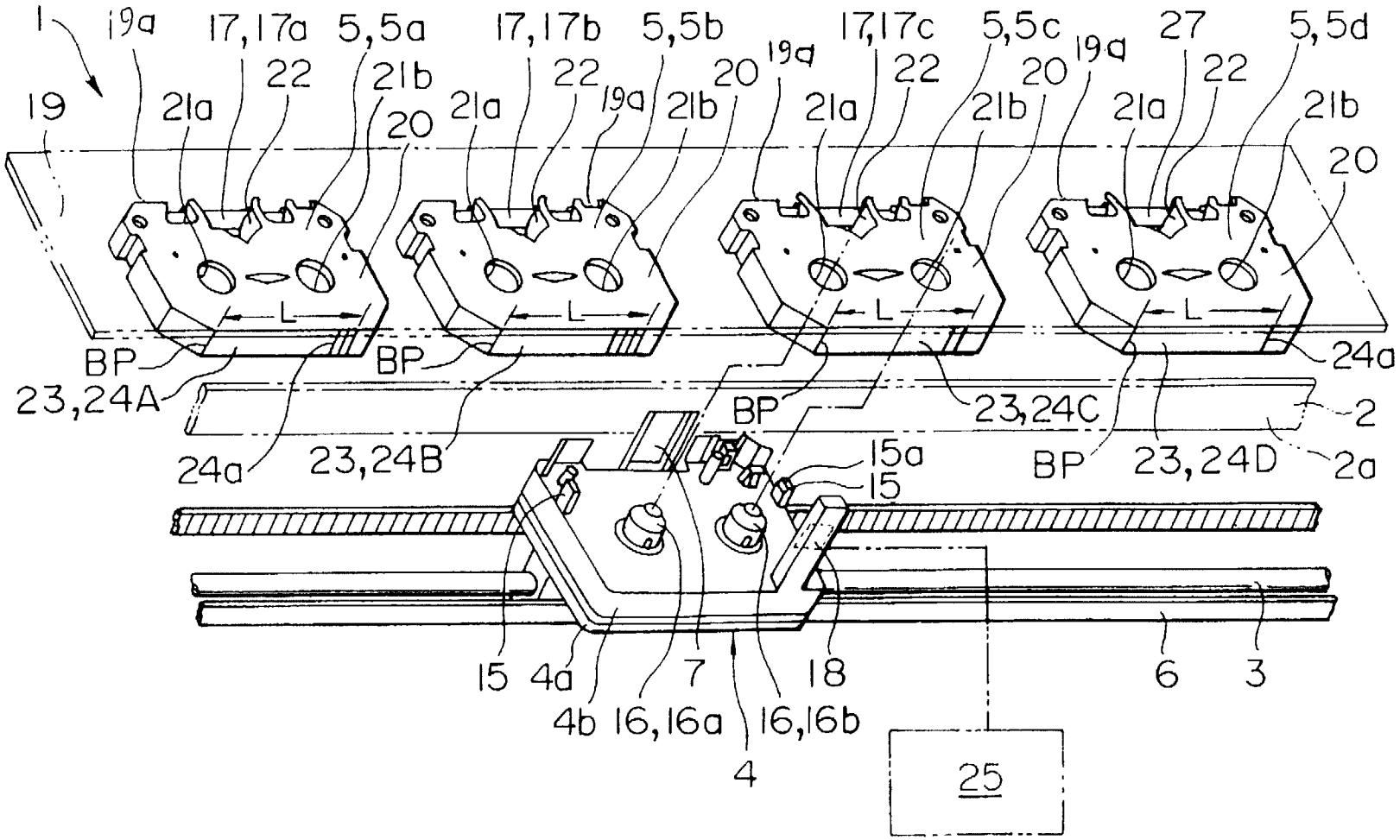
FIG. 1 is a perspective view for describing the construction of the principal portions of a thermal transfer printer according to the present invention.
Figure 2:
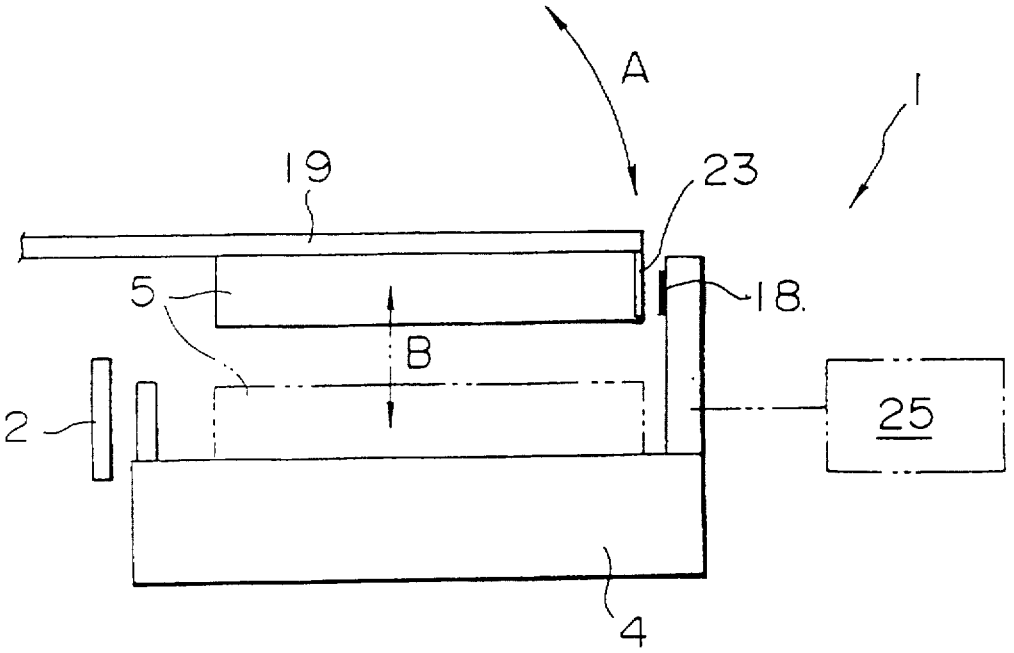
FIG. 2 is a general side view of the principal portions of the thermal transfer printer according to the present invention shown in FIG. 1.
Figure 3:
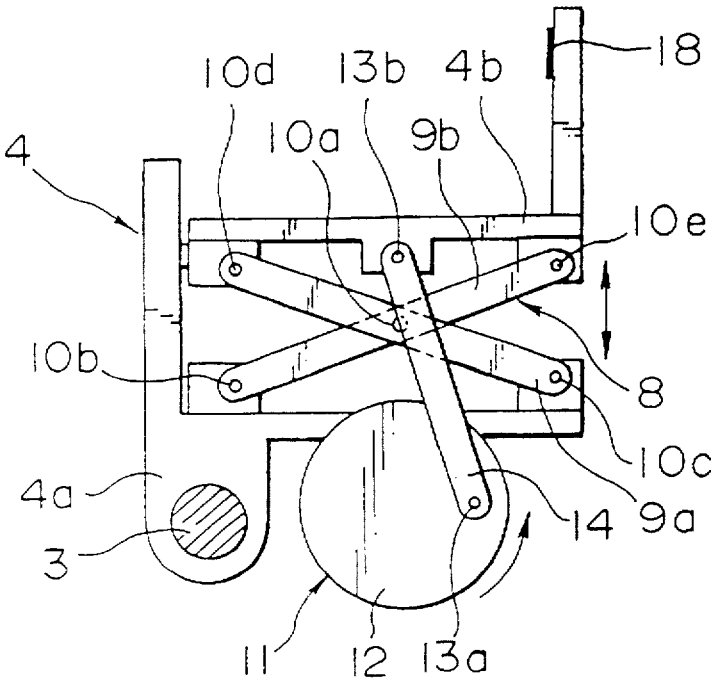
FIG. 3 is a general side view of the thermal transfer printer according to the present invention shown in FIG. 1.
Figure 4:
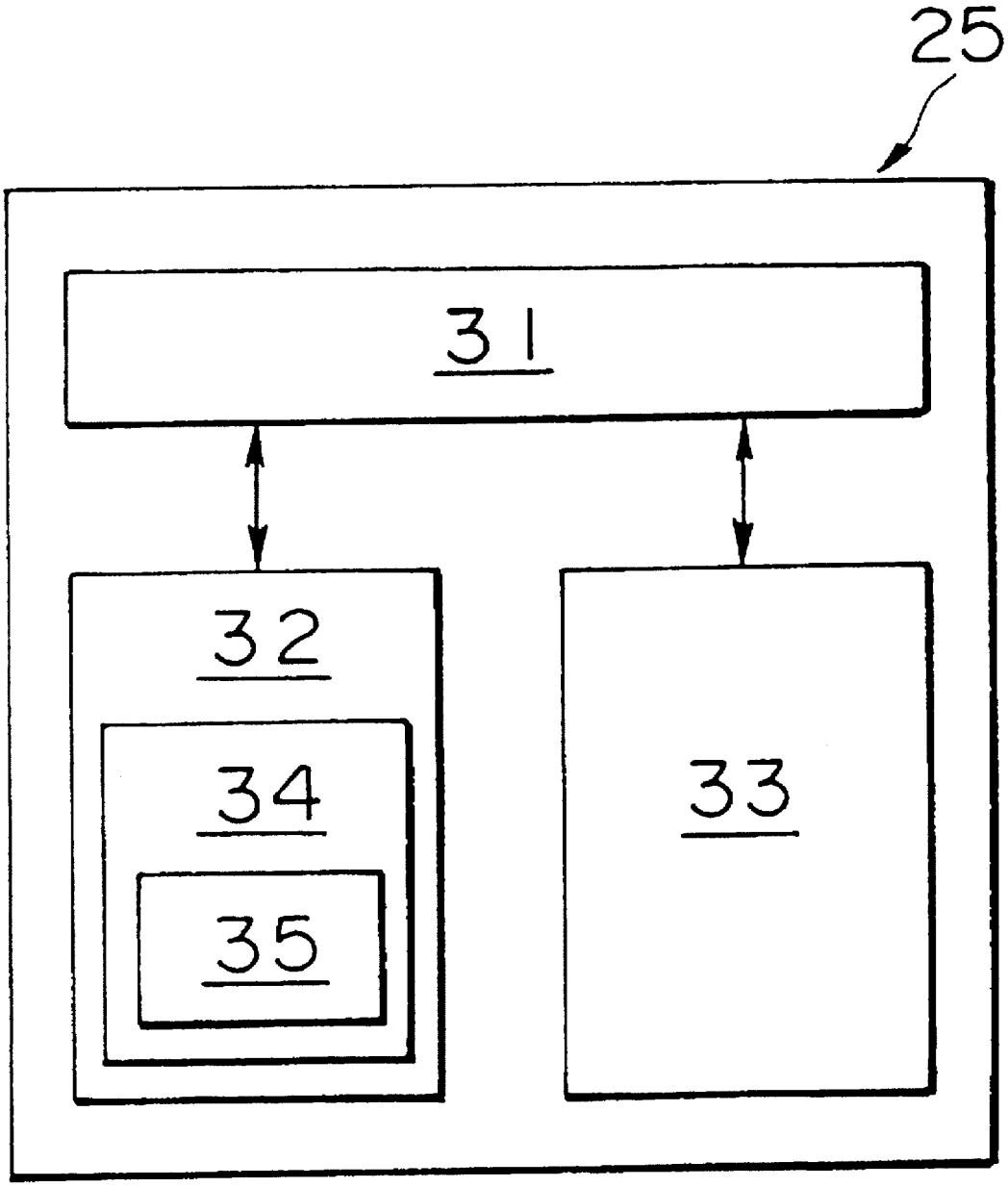
FIG. 4 is a block diagram illustrating the general construction of the control unit of the thermal transfer printer according to the present invention.

FIGS. 1 through 4 illustrate an embodiment of a recording apparatus to which the recording method according to the present invention is applied, wherein FIG. 1 is a perspective view of the principal portions, FIG. 2 is a general side view of the principal portions, FIG. 3 is a general side view of the carriage, and FIG. 4 is a block diagram illustrating the general construction of the control unit.

The recording apparatus according the embodiment of the present invention is capable of recording full-color images to paper using three ribbon cassettes storing three ink ribbons formed of heat-melt ink or heat-sublimation ink of at least the three colors of yellow, magenta, and cyan, and also a ribbon cartridge storing an image adjusting member formed in the shape of the ink ribbons.

As shown in FIG. 1, the thermal transfer printer 1 serving as the recording apparatus according to the embodiment of the present invention has a plate-formed platen 2 which is provided with that the recording surface 2*a* is approximately vertical to a certain position on an unshown printer frame, an a guide shaft 3 is provided to the front and lower side of this platen 2 in a manner parallel to this platen 2. A carriage 4 separated into an upper and lower portion is attached to this guide shaft 3, with the lower portion of this carriage 4 comprising a lower carriage 4*a* which is attached to the aforementioned guide shaft 3, and the upper portion of the carriage 4 comprising an upper carriage 4*b* which is loaded with a ribbon cassette 5 and mounted so as to be separable vertically with regard to the lower carriage 4*a*. This carriage 4 is fixed to a portion of a driving belt 6 wound by a pair of pulleys (not shown), and the aforementioned carriage 4 is reciprocally moved along the aforementioned guide shaft 3 by means of using driving means (not shown) such as a stepping motor or the like for driving this driving belt 6.

The carriage 4 is provided with a thermal head 7 for recording onto paper (not shown) on the platen 2. This thermal head 7 has an array of a plurality of heat-emitting devices (not shown) for selectively generating heat based on desired recording information input from a host computer, image reader, or any input device (not shown) such as a keyboard or the like.

As shown in FIG. 3, a pair of parallel crank mechanism 8 (only one shown) are provided to the left and right sides of the aforementioned carriage 4, thereby allowing the upper carriage 4*b* move in a parallel manner so as to come-into contact with and be disengaged from the lower carriage 4*a* attached to the guide shaft 3. The parallel crank mechanism 8 have a pair of links 9*a* and 9*b* which are intersected in an X-like form, the intersecting portion of the links 9*a* and 9*b* being centrally borne by a pin 10*a*, and the end potions of the links 9*a* and 9*b* being slidably retained to slits (not shown) formed in the upper right and left sides of the lower carriage 4*a* and the lower right and left sides of the upper carriage 4*b* by pins 10*b*, 10*c*, 10*d*, and 10*e*.

A rotating crank mechanism 11 is also formed to the lower carriage 4*a*, this rotating crank mechanism 11 having a rotating plate 12 supported by the lower carriage 4*a* so as to rotatably drive. At an eccentric portion of this rotating plate 12, one end of a linkage link 14 is centrally borne by a pin 13*a*. The other end of this linkage link 14 is centrally borne by the upper carriage by a pin 13*b*. The aforementioned rotating plate 12 is arranged so as to be rotatably driven by driving means such as a motor (not shown), the rotation of this rotating plate 12 moving the upper carriage 4*b* parallel to the lower carriage 4*a* via the aforementioned linkage link 14.

Returning to FIG. 1, a pair of arms 15 formed as plates gradually curving inward one toward another are provided to the upper side of both left and right sides of the aforementioned upper carriage 4*b* in a manner standing at a distance one from another approximately equal to the width of the ribbon cassette 5. Formed at the tips of the arms 15 are engaging portions 15a formed as opposing protrusions for protecting the ribbon cassette 5. Also provided to the center portion of the aforementioned upper carriage 4*b* is a spooling bobbin 16*a* for spooling ink ribbon 17 stored in the ribbon cassette 5 and a feeding bobbin 16*b* for feeding ink ribbon 17, each bobbin being positioned rotatably and separated by a certain distance, arranged such that rotatably driving the aforementioned spooling bobbin 16*a* causes the ink ribbon 17 to be run in a certain direction.

A photo-detector 18 for detecting the type of ink ribbon 17 stored in the ribbon cassette 5 is provided to the upper edge portion of the aforementioned carriage 4 at the far side from the platen 2, this photo-detector 18 being connected to a later-described control unit 25 for performing control such as control of recording operations of the thermal transfer printer 1, the control unit 25 being located at a desired position on the thermal transfer printer 1.

As shown in FIG. 1 and FIG. 2, an approximately plate-shaped canopy 19 supported so as to open and close, as shown by arrow A in FIG. 2, is provided to the aforementioned frame above the carriage 4, so as to have a certain distance from the carriage 4. This canopy 19 serves as a paper presser at the ejecting side of a paper feeding mechanism (not shown), and is generally of the same length as the movement range of the carriage 4, and is facing the carriage 4.

Provided to a certain position to the lower plane of the aforementioned canopy 19 opposing the carriage 4 is a plurality of cassette holders 19*a* for holding the ribbon cassettes 5, with the cassette holders 19*a*, holding the ink ribbons 17*a*, 17*b* and 17*c* comprised of heat-melt ink of at least the three colors yellow, magenta, and cyan, for performing full-color image recording, and also a later-described image adjusting member 27 formed in the shape of an ink ribbon the same as the above ink ribbons 17, the ribbon cassettes 5a, 5b, 5c, and 5d being held in a single row in the direction of movement of the carriage 4. Of these, an ink ribbon 17a comprising yellow heat-melt ink is stored in the ribbon cassette 5a, an ink ribbon 17b comprising magenta heat-melt ink is stored in the ribbon cassette 5b, an ink ribbon 17c comprising cyan heat-melt ink is stored in the ribbon cassette 5c, and heat-resistant film 27 formed in the shape of an ink ribbon is stored in the ribbon cassette 5d.

The ribbon cassettes 5a, 5b, 5c, and 5d are selectively handed between the canopy 19 and upper carriage 4b, as shown by the arrows B in FIG. 2.

Incidentally, in order to form a full-color images, an ink ribbon comprising black heat-melt ink in addition to the aforementioned three heat-melt inks of yellow, magenta, and cyan may be provided; ink ribbons comprising yellow, magenta, cyan, etc., heat-sublimation ink may be provided; and an ink ribbon comprising heat-melt ink having metallic gloss may be combined and used as necessary according to purpose.

As shown in FIG. 1, the main cases 20 of the aforementioned ribbon cassettes 5a, 5b, 5c, and 5d are all of the same form and same dimensions regardless of the type of the ink ribbons 17 and the heat-resistant film 27 stored therein, and the main cases 20 are rotatably provided within with spooling reels 21a for spooling the portion of the ink ribbons 17 supplied for image recording or the heat-resistant film 27 used for image adjustment, and feeding reels 21b for feeding the ink ribbons 17 or the heat-resistant film 27. Also, provided at the plane of the aforementioned ribbon cassette 5 facing the platen 2 when mounted in the carriage 4 is a receded portion 22 to which the thermal head approaches, formed such that the intermediate portion of the ink ribbons 17 or the heat-resistant film 27 is introduced out in this receded portion 22. Further, a pair of rotatably supported ribbon feeding rollers (not shown) and a plurality of guide rollers (not shown) are provided within the aforementioned main cases 20 along the running path of the ink ribbons 17 or the image adjusting member 27.

Also, formed to the rear plane extending parallel to the plane of the ribbon cassette 5 to which the recessed portion 22 has been formed is an identification mark 23 for judging the type of the ink ribbon 17 stored within each of the ribbon cassettes 5 and the image adjusting member 27, this identification mark 23 being formed of a reflective sticker 24 which has stripped non-reflective portions 24a of differing numbers according to the ink ribbons 17 or the heat-resistant film 27 stored within. In the present embodiment, a reflective sticker 24A having three non-reflective portions 24a is applied as an identification mark 23 to the ribbon cassette 5a shown to the left in FIG. 1, and subsequently in sequential order, a reflective sticker 24B having four non-reflective portions 24a is applied as an identification mark 23 to the ribbon cassette 5b, a reflective sticker 24C having two non-reflective portions 24a is applied as an identification mark 23 to the ribbon cassette 5c, and a reflective sticker 24C having one non-reflective portion 24a is applied as an identification mark to the ribbon cassette 5d. Further, the left edge of the rear plane of the ribbon cassette 5 serves as the reference position BP for detecting the identification mark 23, and the distance L to the right end of the non-reflective portion 24a to the right of the identification mark 23 in FIG. 1 is made to be constant for all identification marks 23, and the non-reflective portion 24a is provided within this distance L for identifying the type of ink ribbons 17 or heat-resistant film 27.

This identification mark 23 is detected by a photo-sensor 18 provided to the carriage 4, the detecting signals thereof are output to the control unit 25 of the printer, and the type of ink ribbons 17 or heat-resistant film 27 stored within the ribbon cassette 5 is judged by calculating the number of non-reflective portions 24a on the identification mark 23 of the ribbon cassettes 5 within the control unit 25. Further, the carriage 4 can be stopped in the state that the photo-sensor 18 has detected the identification mark 23 corresponding with the ink ribbon 17 or heat-resistant film 27 to be used, and the arrangement is such that the ribbon cassette 5 provided to the cassette holding of the canopy 19 is automatically handed to the upper carriage 4b in the state that the carriage 4 is stopped.

The heat-resistant film 27 is formed by back-coating a resin film with good heat-resistance and slidability, the base thereof being formed of material such as PET (polyethylene-terepthalate), PA (poly-amide), etc. This back-coating is for heat-resistance for protecting the heat-resistant film 27 from the heat of the thermal head 7 and for providing slidability for preventing sticking between the thermal head 7 and the heat-resistant film 27, and this back-coating is the same as that applied to the ink ribbons 17. Preferable examples for this back-coating include: silicone-modified acrylic resin, silicone-modified ester resin, silicone-modified urethane resin, silicone-modified amide resin, and so forth, due to excellent thin-film coatability. Further, this resin may be impregnated with silicone oil. The back coating is applied at least to the side which faces the surface of the thermal head 7 in the state that the heat-resistant film 27 formed in the shape of an ink ribbon is stored within the ribbon cassette 5d.

As shown in FIG. 4, the aforementioned control unit 25 is comprised of at least a CPU 31, memory 32 formed of appropriate amounts of ROM and RAM, and a controller 33 for driving the components of the recording apparatus such as the thermal head 7.

The aforementioned memory 32 is formed so as to at least perform color separation of the recording information for recording into the three colors of yellow, magenta, and cyan, and store these as recording data according to the color. In the event of actual recording, the recording data of the color corresponding to the color of the ink ribbon 17 to be actually used is output to the controller 33, and this controller 33 selectively drives certain of the plurality of heat-emitting devices of the thermal head 7 and causes generation of heat.

Also, the memory 32 has an image adjusting unit 34 storing an image adjusting operation-performing program for forcibly smoothing the full-color image recorded on paper, this program comprising code for at least the following steps following layering the heat-melt ink or heat-sublimation ink of at least the aforementioned ink ribbons 17: mounting the ribbon cassette 5d which is the ribbon cassette 5 storing the heat-resistant film 27 formed in the shape of an ink ribbon onto the carriage 4; positioning this heat-resistant film 27 formed in the shape of an ink ribbon stored in the ribbon cassette 5d between surface of the thermal head 7 and the full-color image recorded on the paper; following which the surface of the thermal head 7 is brought into contact with the full-color image recorded on the paper, with the heat-resistant film 27 in between; thereby forcibly smoothing the image. Also, this image adjusting unit 34 is provided with an energy adjusting unit 35 storing a program comprising code for adjusting the amount of energy applied to the heat-generating devices of the thermal head 7 during the image adjusting operation so that the amount of energy applied is smaller than the maximum energy supplied to the heat-generating devices of the thermal head 7 when transferring the heat-melt ink to the paper, e.g., in the event that the maximum energy supplied to the heat-generating devices of the thermal head 7 when transferring the heat-melt ink to the paper is 100%, the amount of energy applied to the heat-generating devices of the thermal head 7 during the image adjusting operation is adjusted to be 5 to 50%, for example. The amount of energy to be supplied to the heat-generating devices of the thermal head 7 during the image adjusting operation should be appropriately determined according to the type, thickness, etc., of the heat-resistant film 27. Also, this may be adjusted by moving the carriage 4 at a movement speed faster during the image adjusting operation than the movement speed of the carriage 4 for when recording.

Also, the memory 32 stores: programs for controlling, based on recording information, at least the heat-emitting operation of the heat-emitting devices and the amount of energy supplied to the heat-emitting devices of the thermal head 7 during the image adjusting operation, operation of the thermal head 7 making contact with and separating from the platen 2, and operation of each of the components such as the paper transportation operation of the unshown paper feeding mechanism; programs for detecting the existence/nonexistence of the ribbon cassette 5 and the type of ink ribbon 17 stored in the ribbon cassette 5 based on the output signals from the photo-sensor 18 accompanying movement of the carriage 4, distance of movement of the carriage 4 as to the home position, the open/closed state of the canopy 19, or the distance between a pair of neighboring or distanced ribbon cassettes 5; programs for detecting portions of the full-color image to be recorded to the paper which are of a concentration greater than a certain concentration, based on recording information; and so forth.

Further, the configuration may be such wherein the ribbon cassette **5*d* storing the heat-resistant film 27** can be used inverted or under reverse rotation.

Next, the operation of the present embodiment configured as described above will be described along with the method according to the present invention.

According to the present embodiment, recording information input to the control unit 25 of the thermal transfer printer 1 from an unshown host computer or image reader subjected to color separation into the three ink colors of yellow, magenta, and cyan, and is stored in the memory 32 as recording data for each of the colors. Actual recording us performed in the order or cyan, magenta, yellow, using the respective ribbon cassettes **5*c*, 5*b*, 5*a*, in that order. Chromatic color is comprised of one or a combination of two of the three ink colors of yellow, magenta, or cyan, with area gradation, and achromatic color is comprised of a combination of the three ink colors of yellow, magenta, and cyan color with area gradation. In the event of using heat-sublimation ink, controlling electric energy to the thermal head 7** allows for image recording using concentration gradation.

First, description will be made regarding recording into the paper using the cyan ink which is performed first. Detection of the ribbon cassette **5*c* storing the cyan ink ribbon 17*c* is performed as follows: upon reception of a control command from the control unit 25, the carriage 4 which is a non-mounted state wherein the carriage 4 is not mounted with a ribbon cassette 5 and is in a home position at the left end portion in FIG. 1, for example, is moved toward the right in FIG. 1. The photo-sensor 18 provided to the carriage 4 thus detects the identification mark 23 of the ribbon cassette 5. The photo-sensor 18 sends the unique detection signal of the identification mark 23 comprised of the array and pitch and the like of the non-reflecting portion 24*a* to the control unit 25, where the control unit 25 judges whether or not the identification mark 23 is the identification mark of the ribbon cassette 5*c* corresponding with the control command, and in the event that the identification mark 23 is the identification mark of the ribbon cassette 5*c* corresponding with the control command, movement of the carriage 4 is stopped, and in the event that the identification mark 23 is not the identification mark 23 of the ribbon cassette 5*c* corresponding with the control command, movement of the carriage 4** is continued.

Subsequently, the carriage 4 is stopped at a position facing the corresponding ribbon cassette **5*c*, the parallel crank mechanism 8 and the rotating crank mechanism 11 are driven so as to raise the upper carriage 4*b*, and the ribbon cassette 5*c* storing the cyan ink ribbon 17*c* held by the cassette holder of the canopy 19 is handed to the upper carriage 4*b*. The parallel crank mechanism 8 and the rotating crank mechanism 11 are driven again, and the upper carriage 4*b* is lowered so as to come into contact with the lower carriage 4*a*. Accordingly, the carriage 4 is in the sate of being mounted with the ribbon cassette 5*c* storing the ink ribbon 17*c***.

Next, an unshown known paper feeding mechanism is used to transport paper to a certain position between the thermal head 7 and platen 2, and the aforementioned thermal head 7 is placed in the head-down position so as to be pressed to the recording surface **2*a* of the platen 2 with the cyan ink ribbon 17*c* and the paper between, and in this state the carriage 4 is moved along the platen 2 while spooling the ink ribbon 17*c* and selectively providing electroconducting to the heat-emitting devices of the thermal head 7 according to the concentration of the image to be recorded from the control unit 25 so as to cause the heat-emitting devices to emit head, thus transferring a portion of the cyan heat-melt ink of the ink ribbon 17*c*** to the paper, thereby recording in cyan on the paper.

Once this cyan recording is completed, the carriage 4 is stepped at a position facing the unshown cassette holder which had been holding the ribbon cassette **5*c* used for the recording, the upper carriage 4*b* is raised in the same manner as described above, and the ribbon cassette 5*c* storing the cyan ink ribbon 17*c* mounted on this upper carriage 4*b*** is automatically handed to the cassette holder.

Next, the identification mark 23 of the ribbon cassette **5*b* storing the magenta ink ribbon 17*b* to be used for the next recording is detected by the photo-sensor 18, this ribbon cassette 5*b* is mounted on the carriage 4, and magenta recording using the ribbon cassette 5*b*** is performed in the same manner as the preceding cyan recording.

After this magenta recording is completed, yellow recording is performed in the same manner.

Also, the surface of the thermal head 7 is generally cleaned using an unshown known cleaning mechanism either each time recording is performed with the colors, or according to need such as after a certain usage time elapses.

Now, while most color images are recorded by layering heat-melt ink of two or fewer colors, layering heat-melt ink of three colors, i.e., cyan, magenta, and yellow, must be performed to obtain black and high-concentration grays.

Also, in the event that full-color recording is performed on the paper by layering heat-melt ink of cyan, magenta, and yellow, each color is recorded using multiple gradation expressions employing area gradation patterns such as dithering or the like. Now, in the event of recording an image on paper using heat-melt ink, the ink must be separated from the ink ribbon before the ink cools and hardens following melting and recording onto the paper, due to the nature of heat-melt ink, and this is particularly true in the case of ink using resin as binder. This is because that in the case that the ink is separated from the ink ribbon after the ink cools and hardens, the ink which has been transferred to the paper is transferred back to the ink ribbon, and a recorded image of good quality cannot be obtained. Regarding recording using peeling while the ink is hot, the ink ribbon is peeled from the paper while the ink is still in a molten state, causing unevenness in the surface of the ink transferred onto the paper, which causes irregular reflection of white light at this portion, deterioration of saturation creates the problem of dullness, and a recorded image of good quality cannot be obtained.

Accordingly, with the present embodiment, following recording by the three colors, cyan, magenta, and yellow, a control command is issued from the control unit 25 to perform image adjusting operation. This image adjusting operation is performed in a manner similar to that of the above example, in that the photo-sensor 18 detects the identification park 23 of a ribbon cassette 5 based on the control command from the control unit 25. The photo-sensor 18 then sends the unique detection signal of the identification mark 23 comprised of the array and pitch and the like of the non-reflecting portion 24*a* to the control unit 25, where the control unit 25 judges whether or not the identification mark 23 is the identification mark 23 of the ribbon cassette 5*d* storing the heat-resistant film 27. In the event that the identification mark 23 is the identification mark 23 of the ribbon cassette 5*d* storing the heat-resistant film 27 corresponding with the control command, movement of the carriage is stopped, and in the event that the identification mark 23 is not the identification mark 23 of the ribbon cassette 5*d* storing the heat-resistant film 27 corresponding with the control command, movement of the carriage 4 is continued until the identification mark 23 of the ribbon cassette 5*d* corresponding with the control command is detected.

Subsequently, the carriage 4 is stopped at a position facing the corresponding ribbon cassette 5*d*, and the carriage 4 is mounted with the ribbon cassette 5*d* storing the heat-resistant film 27.

Then, the carriage 4 is moved along the platen 2 in the state of being mounted with the ribbon cassette 5*d*, and the thermal head 7 is brought into contact with the surface of the full-color image across the heat-resistant film 27, thereby forcibly smoothing the surface of the full-color image.

Incidentally, since bringing the thermal head 7 into contact with the paper or disrupting the contact while the carriage 4 is moving along the platen 2 may cause damage to the unshown known contact/cut-off mechanism due to excessive operation, so it is preferable to move the carriage 4 along the platen 2 with the aforementioned thermal head 7 placed in the head-down position so as to be pressed to the paper with the heat-resistant film 27 between. Also, in this case, the surface of the thermal head 7 slides across the full-color image recorded on the paper with the image adjusting member 27 between, and thereby, the full-color image can be smoothed even further.

Such image adjusting operation allows for easily obtaining a high quality full-color image which has no dullness throughout the image, and which is glossy and vivid.

Also, since the amount of energy applied to the heat-generating devices of the thermal head 7 during the image adjusting operation is smaller than the maximum energy supplied to the heat-generating devices of the thermal head 7 when transferring the heat-melt ink to the paper, based on programs stored in the energy adjusting unit 35, blotching, running, or clotting of the ink transferred to the paper with the image adjusting member can be prevented during the image adjusting operation, thus realizing sure smoothing of the surface of the transferred ink, and an image with even higher recording quality can be easily obtained.

Also, the surface of the thermal head 7 is pressed against the full color image recorded on the paper with the heat-resistant film 27 between, so the surface of the thermal head including the area thereof provided with the heat-emitting devices is not directly in contact with the image recorded on the paper, thereby preventing ink from the recorded image adhering to and soiling the thermal head or dust or the like adhering to and damaging the surface of the thermal head 7.

Also, in the case of layering heat-sublimation ink of the colors yellow, magenta, and cyan to record a full-color image on the paper, the amount of energy supplied to the thermal head 7 for heat-sublimation of the heat-sublimation ink is small at portions where the color of the recorded image is light and the concentration is low, and as a result, the heat-sublimation ink transferred onto the paper is smooth and the obtained image is glossy and vivid. On the other hand, the amount of energy supplied to the thermal head 7 for heat-sublimation of the heat-sublimation ink on the ink ribbon is great at portions where the recorded image is of high concentration, and as a result, so-called matting wherein the image transferred to the paper becomes dull due to thermal warping of the surface of the paper, and consequently, glossy portions and dull portions exist in the recorded image in a mixed manner, so that a recorded image of good quality cannot be obtained.

Accordingly, with the present embodiment, following recording by the three colors, yellow, magenta, and cyan, a control command is issued from the control unit 25 to perform image adjusting operation. This image adjusting operation is performed in a manner similar to that of the above example, in that the photo-sensor 18 detects the identification park 23 of a ribbon cassette 5 based on the control command from the control unit 25. The photo-sensor 18 then sends the unique detection signal of the identification mark 23 comprised of the array and pitch and the like of the non-reflecting portion 24*a* to the control unit 25, where the control unit 25 judges whether or not the identification mark 23 is the identification mark 23 of the ribbon cassette 5*d* storing the image adjusting member 27. In the event that the identification mark 23 is the identification mark 23 of the ribbon cassette 5*d* storing the heat-resistant film 27 corresponding with the control command, movement of the carriage 4 is stopped, and in the event that the identification mark 23 is not the identification mark 23 of the ribbon cassette 5*d* storing the heat-resistant film 27 corresponding with the control command, movement of the carriage 4 is continued until the identification mark 23 of the ribbon cassette 5*a* corresponding with the control command is detected.

Subsequently, the carriage 4 is stopped at a position facing the corresponding ribbon cassette 5*d*, and the carriage 4 is mounted with the ribbon cassette 5*d* storing the image adjusting member 27.

Then, the carriage 4 is moved along the platen 2 in the state of being mounted with the ribbon cassette 5*d*, and the thermal head 7 is brought into contact with the surface of the full-color image across the image adjusting member 27, thereby forcibly smoothing the surface of the full-color image.

Incidentally, since bringing the thermal head 7 into contact with the paper or disrupting the contact while the carriage 4 is moving along the platen 2 may cause damage to the unshown known contact/cut-off mechanism due to excessive operation, so it is preferable to move the carriage 4 along the platen 2 with the aforementioned thermal head 7 placed in the head-down position so as to be pressed to the paper with the image adjusting member 27 between. Also, in this case, the surface of the thermal head 7 slides across the full-color image recorded on the paper with the heat-resistant film 27 between, and thereby, the full-color image can be smoothed even further.

Such image adjusting operation allows for easily obtaining a high quality full-color image which has no dullness which is called matting throughout the image, and which is glossy and vivid.

Also, the amount of energy applied to the heat-generating devices of the thermal head 7 during the image adjusting operation is smaller than the maximum energy supplied to the heat-generating devices of the thermal head 7 when transferring the heat-sublimation ink to the paper, based on programs stored in the energy adjusting unit 35, thereby preventing dullness called matting originating due to the image adjusting operation itself, and also assisting in dispersion and coloring of the unresponding heat-sublimation pigments comprising the heat-sublimation ink, thus easily obtaining a color recorded image of even higher quality.

What is claimed is:

1. A method of printing a high-quality image, using a thermal transfer printer that is loaded with a plurality of ribbon cassettes and has a thermal head for heating ink ribbons advanced from said ribbon cassettes, wherein said printer, while reciprocating said thermal head along a path of travel across a recording medium, heats said ink ribbons in sequence with said thermal head to transfer ink from said ink ribbons onto said recording medium to thereby produce an image on said recording medium, said method including the steps of:

(a) loading said printer with said plurality of ribbon cassettes one of which contains a heat-resistant film in lieu of said ink ribbon;

(b) applying a maximum drive energy to said thermal head to heat the ink ribbon advanced from one of said ribbon cassettes to transfer ink from said ink ribbon onto said recording medium while said thermal head travels across said recording medium;

(c) repeating said step (b) with the ink ribbon of another ribbon cassette until production of an image is completed on said recording medium; and (d) applying a lower drive energy than said maximum energy to said thermal head during its last travel across said recording medium to heat said produced image through said heat-resistant film in order to smooth the surface of said produced image.

* * * * *

UNITED STATES PATENT AND TRADEMARK OFFICE

CERTIFICATE OF CORRECTION

PATENT NO. : 5,896,161
DATED : April 20, 1999
INVENTOR(S) : Hiroshi Kobayashi

It is certified that error appears in the above-identified patent and that said Letters Patent is hereby corrected as shown below:

On the Title Page

Item [30] under "Foreign Application Priority Data", replace "Jan. 20, 1997" with --Feb. 20, 1997--.

In column 2, line 3, under "ABSTRACT", replace "ribon" with --ribbon--.

Signed and Sealed this

Twenty-third Day of November, 1999

*Attest:*

*Attesting Officer*

Q. TODD DICKINSON

*Acting Commissioner of Patents and Trademarks*